US010842232B1

(12) United States Patent
Kelly

(10) Patent No.: US 10,842,232 B1
(45) Date of Patent: Nov. 24, 2020

(54) RATCHETING BUCKLE

(71) Applicant: CHMLN, LLC, Springville, UT (US)

(72) Inventor: Dylan Kelly, Springville, UT (US)

(73) Assignee: CHMLN, LLC, Springville, UT (US)

( * ) Notice: Subject to any disclaimer, the term of this patent is extended or adjusted under 35 U.S.C. 154(b) by 0 days.

(21) Appl. No.: 16/595,668

(22) Filed: Oct. 8, 2019

(51) Int. Cl.
*A44B 11/12* (2006.01)

(52) U.S. Cl.
CPC ..... *A44B 11/125* (2013.01); *Y10T 24/2192* (2015.01); *Y10T 24/32* (2015.01); *Y10T 24/4072* (2015.01)

(58) Field of Classification Search
CPC ..... A44B 11/125; A41F 1/008; Y10T 24/21; Y10T 24/2113; Y10T 24/2106; Y10T 24/141; Y10T 24/1482; Y10T 24/1498; Y10T 24/4072; Y10T 24/2192; Y10T 24/216; Y10T 24/2183; Y10T 24/32; Y10T 24/3984; Y10T 24/45602; Y10T 24/2175
See application file for complete search history.

(56) References Cited

U.S. PATENT DOCUMENTS 4,727,630 A * 3/1988 Alan ..... A44B 11/26 24/593.11
5,184,352 A * 2/1993 Maufette ..... A41F 9/002 24/579.09
5,219,423 A * 6/1993 Kamaya ..... A45C 7/0086 224/583
5,267,679 A * 12/1993 Kamaya ..... A45C 7/0086 190/102
5,774,953 A * 7/1998 Mao ..... A44B 11/2592 24/170
5,896,586 A * 4/1999 Freund ..... A42B 3/145 2/416
6,161,267 A * 12/2000 Trautwein ..... H02G 3/0406 24/635
6,219,889 B1 * 4/2001 Lovato ..... A44B 11/12 24/170
7,246,383 B2 * 7/2007 Musal ..... A42B 3/145 2/418
7,296,305 B2 * 11/2007 Ketterer ..... A44B 11/223 2/418
7,966,701 B2 * 6/2011 Shiue ..... A61F 9/027 24/170
9,247,788 B2 * 2/2016 Brace ..... A62B 18/084
9,259,058 B2 * 2/2016 Brace ..... A41D 13/1161
10,159,291 B1 * 12/2018 Ortega ..... A44B 11/266
2011/0030179 A1 * 2/2011 Shiue ..... A44B 11/20 24/594.11
2011/0290840 A1 * 12/2011 Huang ..... B60R 9/10 224/539
2015/0113770 A1 * 4/2015 Laatz ..... A47F 5/0006 24/191
2015/0313319 A1 * 11/2015 Ha ..... A43C 11/165 24/303

* cited by examiner

*Primary Examiner* — Robert Sandy
*Assistant Examiner* — Michael S Lee
(74) *Attorney, Agent, or Firm* — Kirton McConkie; Brian Tucker

(57) ABSTRACT

A ratcheting buckle can be used on watches, belts, other types of apparel or any item having a band. The ratcheting buckle allows a band to be adjusted in much smaller increments than traditional bands. A unique buckle configuration enables this ratcheting to be achieved without sacrificing aesthetic appeal or usability.

20 Claims, 14 Drawing Sheets

RATCHETING BUCKLE

CROSS-REFERENCE TO RELATED APPLICATIONS

N/A

BRIEF SUMMARY

The present invention extends to a ratcheting buckle that can be used on watches, belts, other types of apparel or any item having a band. The ratcheting buckle allows a band to be adjusted in much smaller increments than traditional bands. A unique buckle configuration enables this ratcheting to be achieved without sacrificing aesthetic appeal or usability.

In one embodiment, the present invention is implemented as a ratcheting buckle that includes an outer housing, an inner housing that couples to the outer housing to form a channel, and a ratcheting assembly that is positioned within the outer housing adjacent to the channel. The ratcheting assembly includes opposing actuating members that are configured to move along an axis and a ratchet lock that is configured to rotate about the axis and that includes a locking tab. The opposing actuating members are interfaced with the ratchet lock such that, as the opposing actuating members are moved along the axis, the ratchet lock rotates about the axis to cause the locking tab to be selectively positioned within the channel.

In another embodiment, the present invention is implemented as a ratcheting buckle that includes an outer housing forming an outer surface, an inner housing that couples to the outer housing to form a channel between the outer surface and the inner housing and a ratcheting assembly that includes opposing actuating members, a ratchet lock and a first rail that interconnects the opposing actuating members and the ratchet lock. The first rail defines an axis along which the opposing actuating members move and about which the ratchet lock rotates. The ratchet lock includes a locking tab that rotates into and out from the channel as the ratchet lock rotates about the axis.

In another embodiment, the present invention is implemented as a ratcheting buckle that includes an outer housing forming an outer surface, an inner housing that couples to the outer housing to form a channel between the outer surface and the inner housing, a ratcheting assembly and a magnet assembly. The ratcheting assembly includes one or more actuating members and a ratchet lock that is interconnected with the one or more actuating members. The one or more actuating members are configured to move along an axis, while the ratchet lock is configured to rotate around the axis. The ratchet lock includes a locking tab and a ratchet lock actuating member. The magnet assembly is positioned adjacent the ratchet lock actuating member.

This summary is provided to introduce a selection of concepts in a simplified form that are further described below in the Detailed Description. This Summary is not intended to identify key features or essential features of the claimed subject matter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figure 1A:
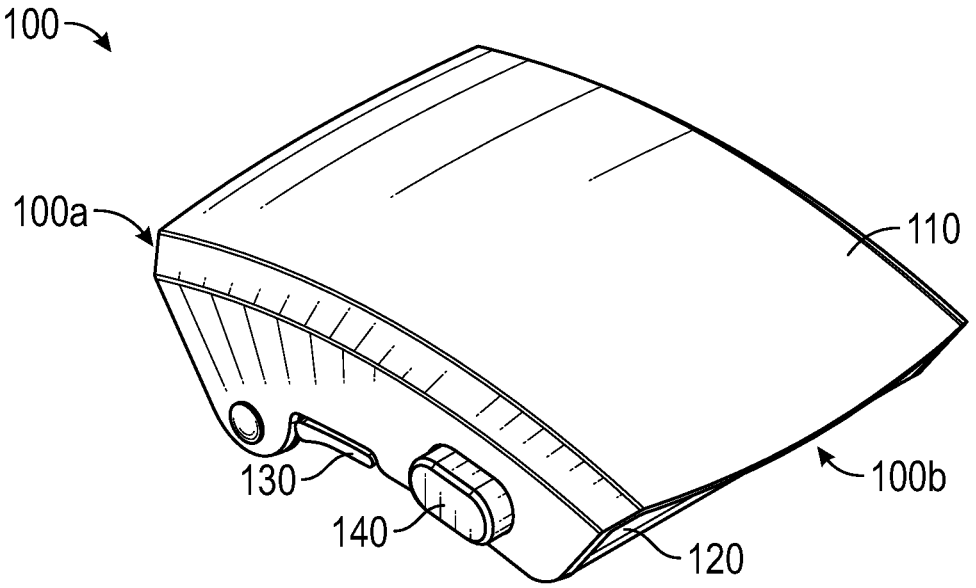
FIG. 1A illustrates a top perspective view of a ratcheting buckle that is configured in accordance with embodiments of the present invention.
Figure 1B:
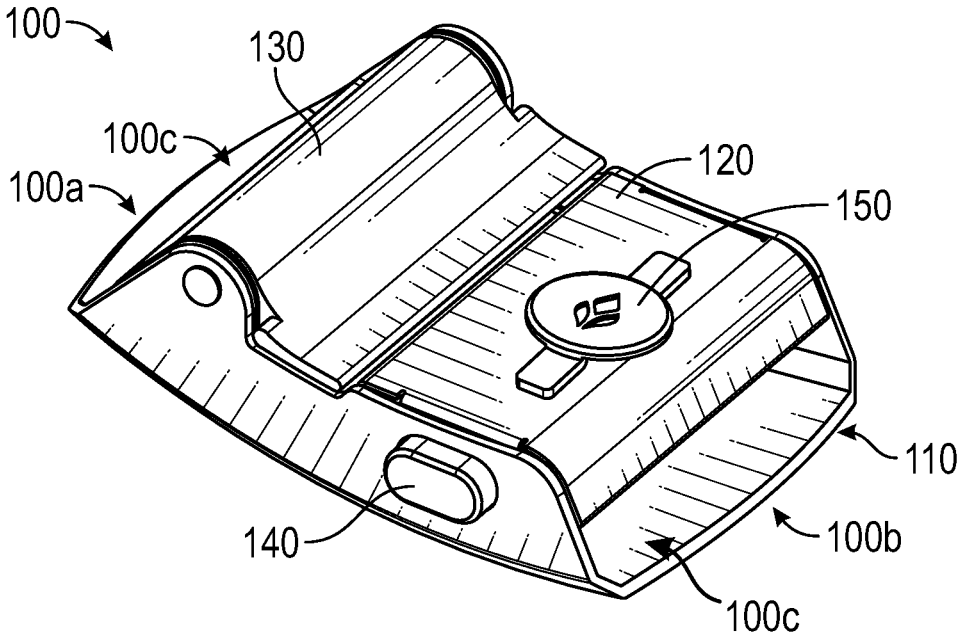
FIG. 1B illustrates a bottom perspective view of the ratcheting buckle of FIG. 1A.
Figure 1C:
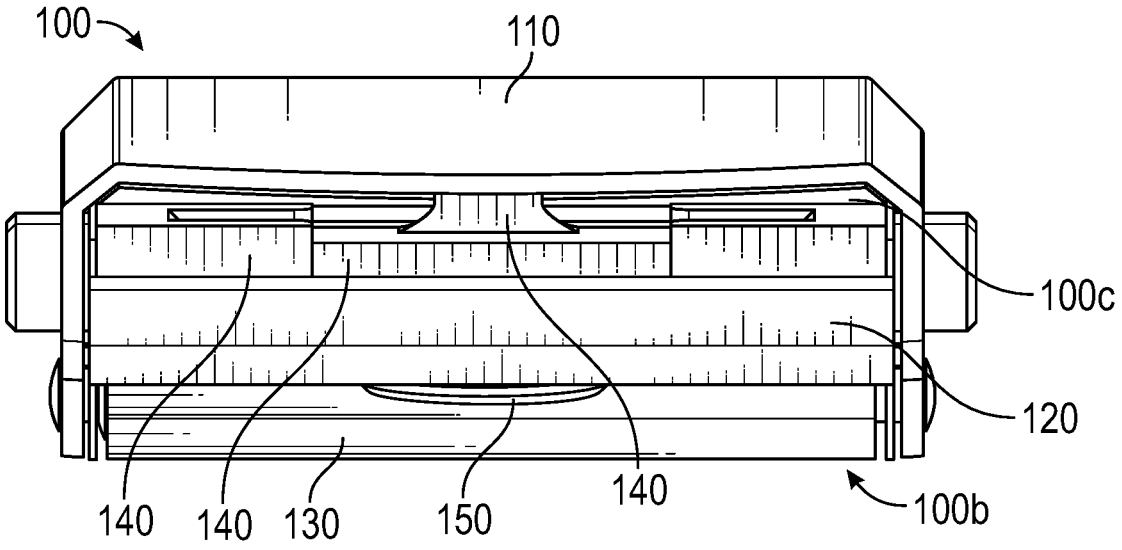
FIGS. 1C and 1D illustrate opposing end views of the ratcheting buckle of FIG. 1A.
Figure 1D:
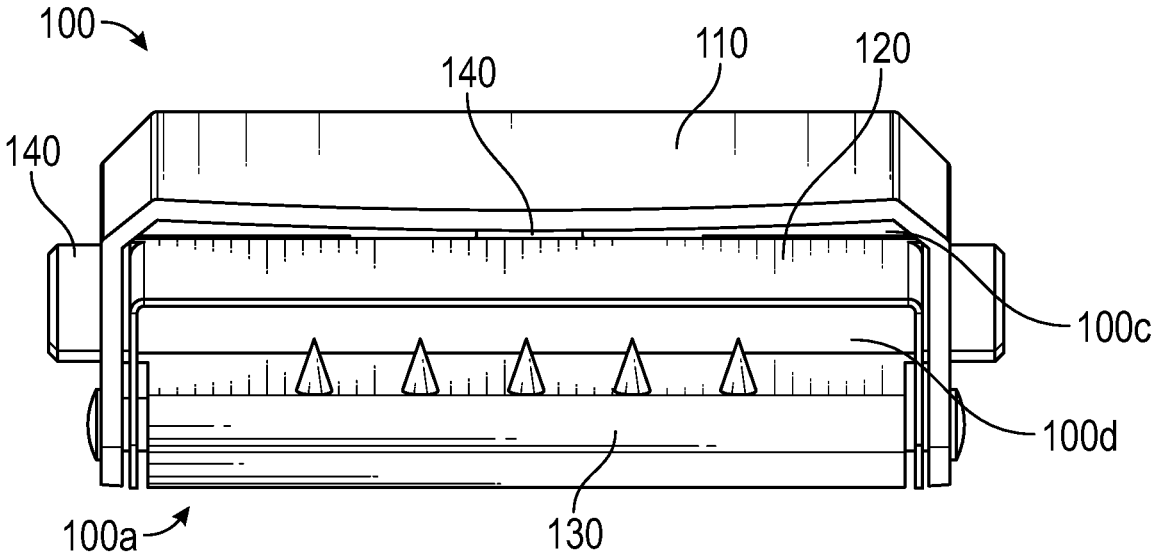
Figure 1E:
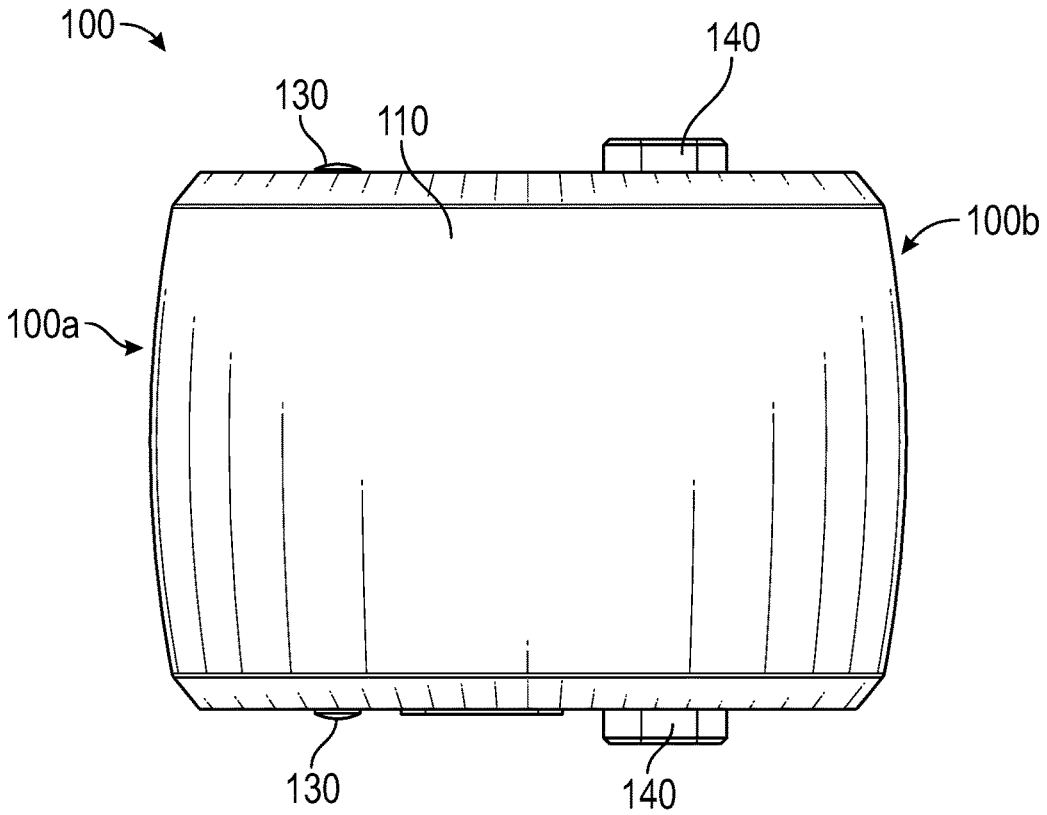
FIG. 1E illustrates a top view of the ratcheting buckle of FIG. 1A.
Figure 1F:
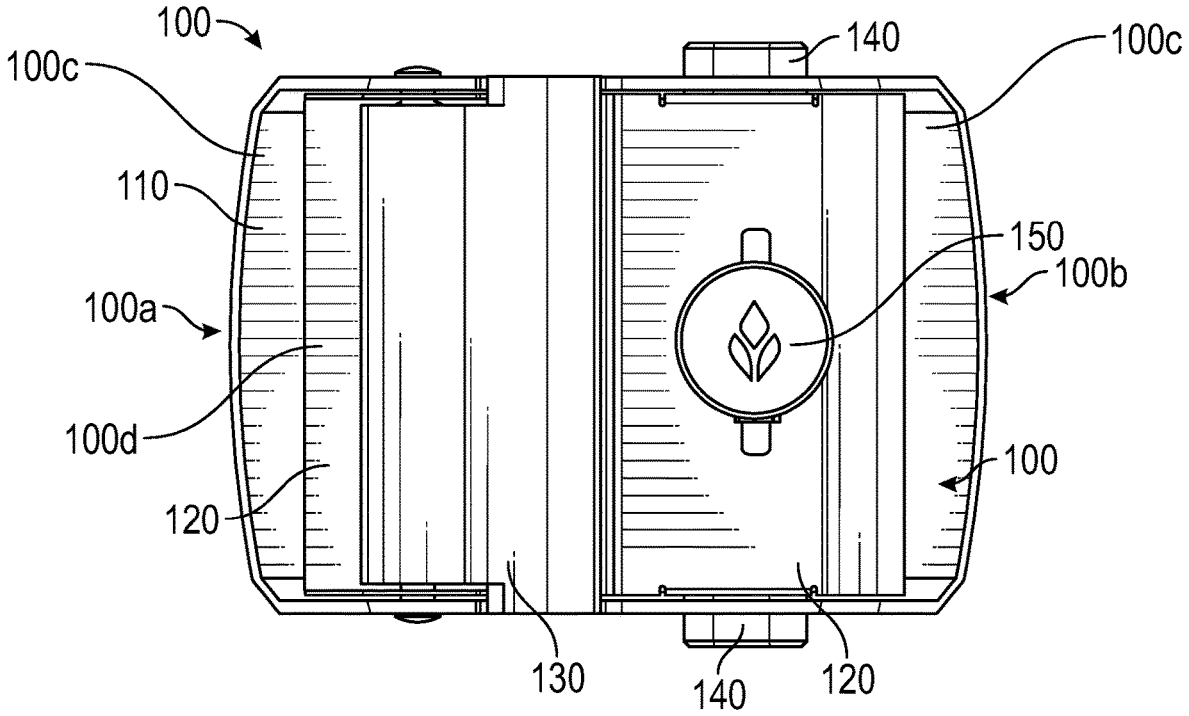
FIG. 1F illustrates a bottom view of the ratcheting buckle of FIG. 1A.
Figure 1G:
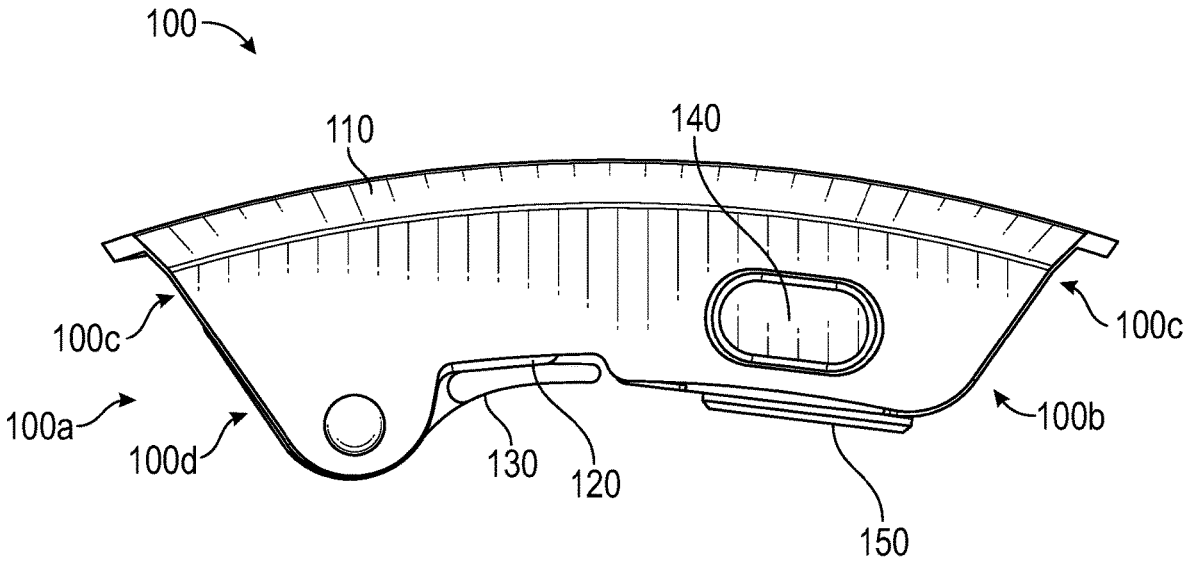
FIG. 1G illustrates a side view of the ratcheting buckle of FIG. 1A.

FIGS. 1A-1G and 2 each illustrates a different view of a ratcheting buckle 100 that is configured in accordance with embodiments of the present invention. As shown, ratcheting buckle 100 includes an outer housing 110, an inner housing 120, a band grip 130, a ratcheting assembly 140 and a magnet assembly 150. Outer housing 110 and inner housing 120 extend between a fixed end 100*a* and an adjustable end 100*b* of ratcheting buckle 100. In this context, "outer" refers to the fact that outer housing 110 is typically intended to face outwardly when an item that includes ratcheting buckle 100 (e.g., a watch) is worn, while "inner" refers to the fact that inner housing 120 is typically intended to face inwardly. However, ratcheting buckle 100 could equally be used on items where outer housing 110 and inner housing 120 may not face outwardly or inwardly respectively. The term "outer" and "inner" should therefore be construed as defining the position of outer housing relative to inner housing. Fixed end 100*a* represents the end of ratcheting buckle 100 into which a band may be inserted and fixed. In contrast, adjustable end 100*b* is the end of ratcheting buckle 100 into which a band may be adjustably inserted. In some embodiments, ratcheting buckle 100 may be used with one band (e.g., a belt) or with two bands (e.g., a watch, a hat, suspenders, footwear, etc.).

Inner housing 120 can be configured to couple with outer housing 110 to form a channel 100*c* through which a band can adjustably extend. Channel 100*c* may extend fully between adjustable end 100*b* and fixed end 100*a* to allow a band to extend fully through ratcheting buckle 100. A slot 100*d* is also formed at fixed end 100*a* inwardly adjacent to channel 100*c* and functions to receive and fix an end of a band. Band grip 130 can be secured to either or both outer housing 110 and inner housing 120 within slot 110*d* and functions to selectively fix the end of the band within slot 110*d*.

A ratcheting assembly 140 is contained within outer housing 110 (and in the depicted embodiment is also contained within inner housing 120) and extends into channel 100*c* to provide ratcheting functionality to a band that is inserted into channel 100*c*. A magnet assembly 150 is also contained within outer housing 110 (and in the depicted embodiment is also contained within inner housing 120) and is positioned adjacent ratcheting assembly 140 opposite channel 100*c*.

Figure 2:
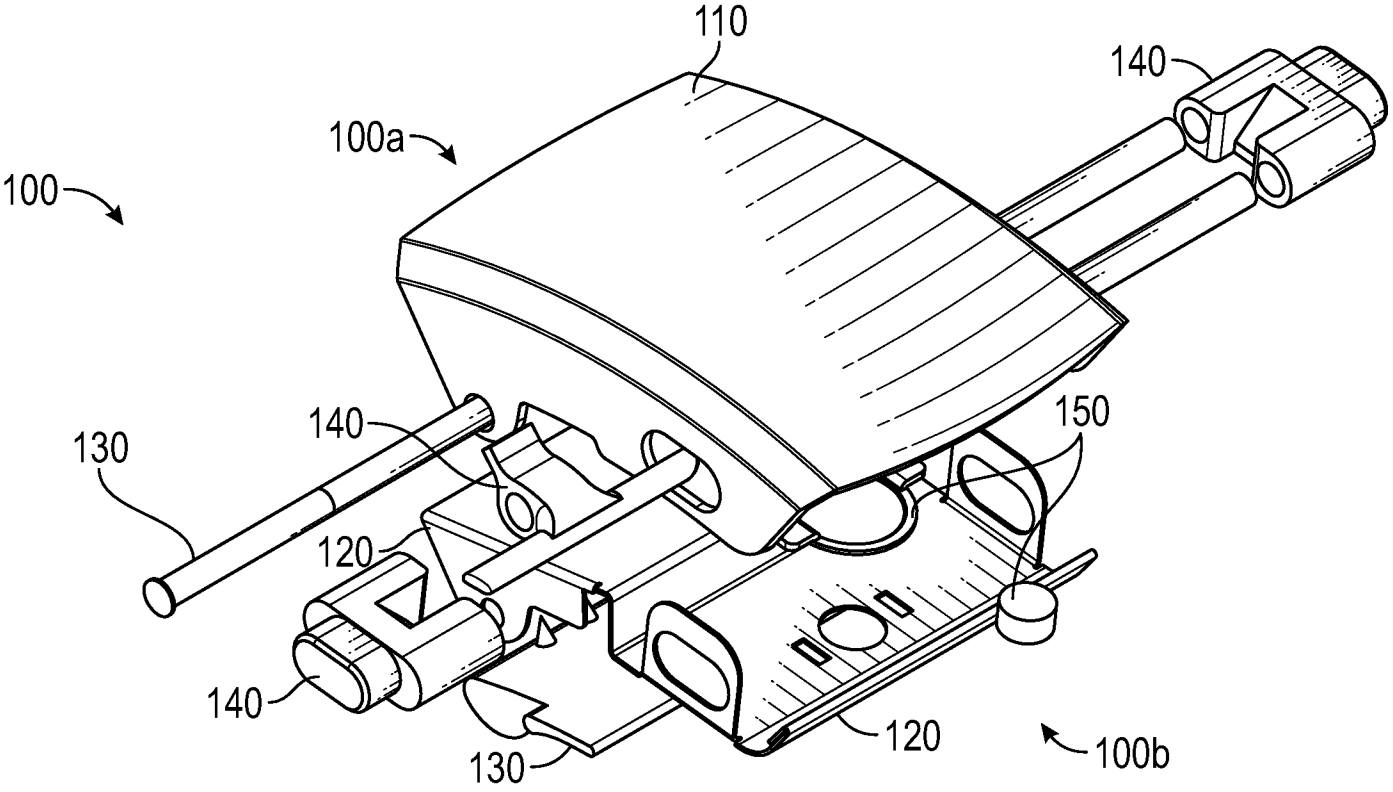
FIG. 2 illustrates an exploded top perspective view of the ratcheting buckle of FIG. 1A.
Figure 2A:
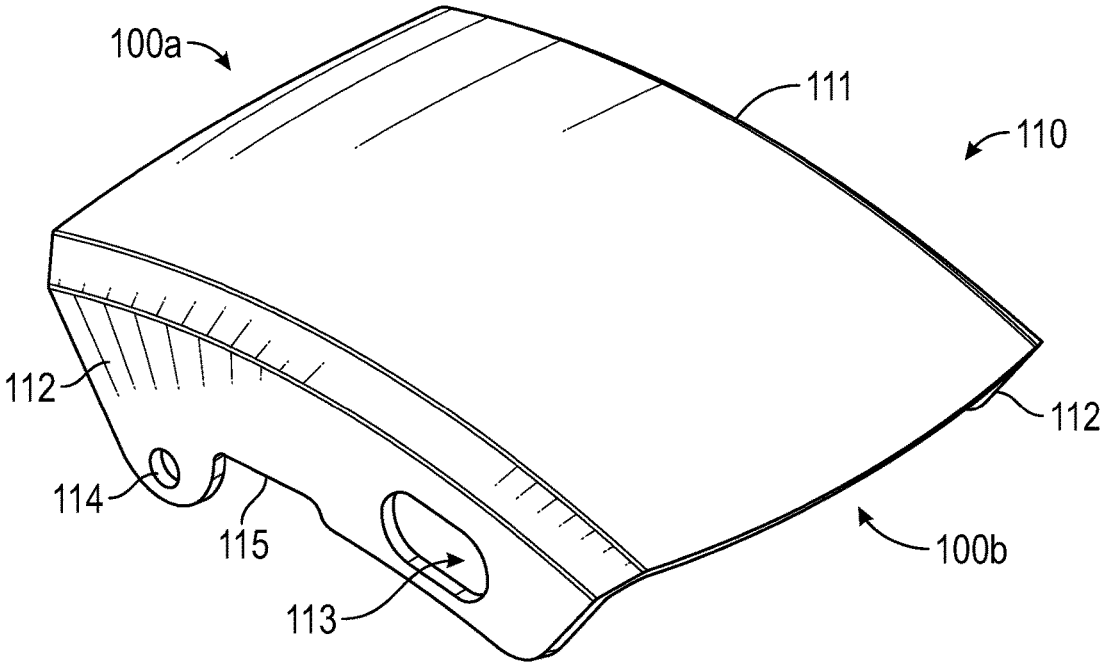
FIG. 2A illustrates an outer housing of the ratcheting buckle in isolation.

FIG. 2A illustrates outer housing 110 in isolation. Outer housing 110 includes an outer surface (or face) 111 that extends from fixed end 100*a* to adjustable end 100*b*. A pair of opposing sidewalls 112 extend inwardly from outer surface 111. A button opening 113 is formed in each sidewall 112 towards adjustable end 100*b*. Button openings 113, which may be aligned, allow ratcheting assembly 140 to extend outwardly through outer housing 110. A pin opening 114 is formed in each sidewall 112 towards fixed end 100*b*. Pin openings 114, which may also be aligned, allow band grip 130 to extend outwardly through (or at least couple to) outer housing 114. A band grip tab receiving slot 115 is also formed in each sidewall 112 between button openings 113 and pin openings 114. Band grip tab receiving slots 115 receive a portion of band grip 130 when band grip 130 is in the closed position.

Figure 2B:
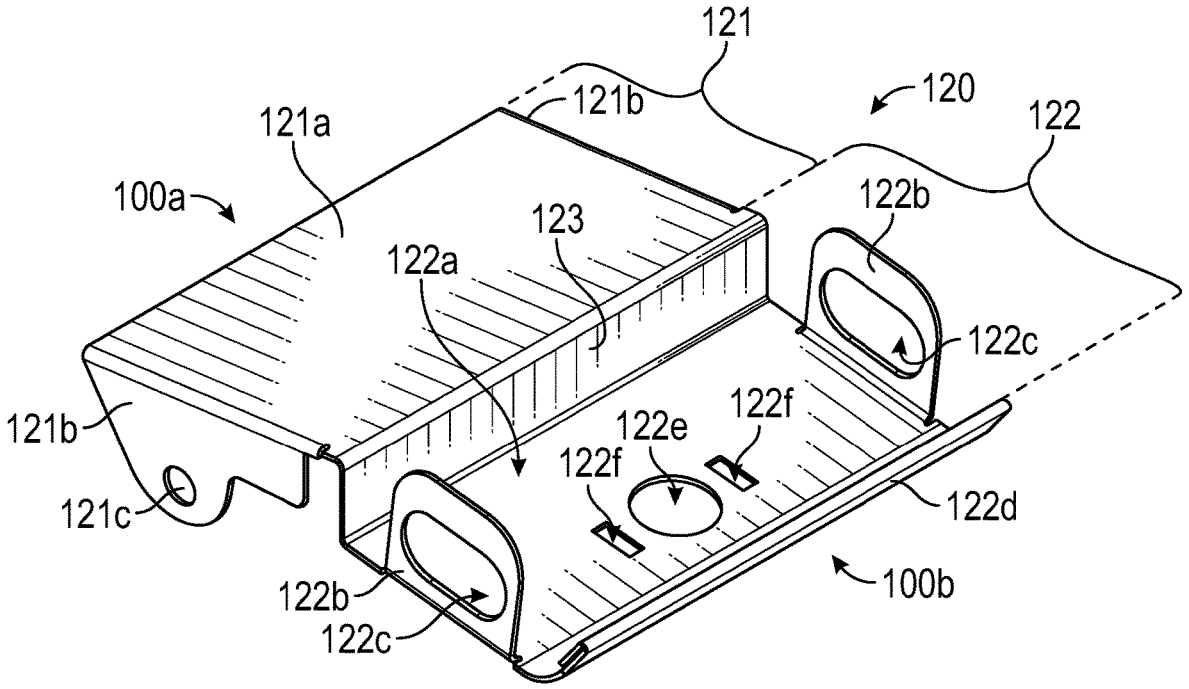
FIG. 2B illustrates an inner housing of the ratcheting buckle in isolation.

FIG. 2B illustrates inner housing 120 in isolation. Inner housing 120 includes a band receiving portion 121 that is formed towards fixed end 100*a* and a ratcheting assembly portion 122 that is formed towards adjustable end 100*b*. Band receiving portion 121 includes an outer surface 121*a* and opposing sidewalls 121*b* which extend inwardly from outer surface 121*a*. A pin opening 121*c* is formed in each sidewall 121*b* and spaced inwardly from outer surface 121*a*. Pin openings 121*c* align with pin openings 114 to allow band grip 130 to extend therethrough. The shape of sidewalls 121*b* may also substantially align with the shape of the corresponding portions of sidewalls 112 including the shape of band grip tab receiving slot 115.

Ratcheting assembly portion 122 includes an inner surface 122*a*, opposing sidewalls 122*b* that extend outwardly from inner surface 122*a* and an end wall 122*d* that is positioned at adjustable end 100*b* and extends outwardly from inner surface 122*a* substantially perpendicular to sidewalls 122*b*. A button opening 122*c* is formed in each sidewall 122*b* and aligns with a corresponding button opening 113 to allow ratcheting assembly 140 to extend therethrough. A magnet opening 122*e* and magnet holder openings 122*f* are formed through inner surface 122*a* and may be positioned centrally within inner surface 122*a*. As shown, two magnet holder openings 122*f* may be positioned on opposing sides of magnet opening 122*e*.

Band receiving portion 121 is connected to ratcheting assembly portion 122 via a dividing portion 123. Dividing portion 123 extends inwardly from outer surface 121*a* and outwardly from inner surface 122*a* to thereby function as a wall that divides the inward facing area of band receiving portion 121 from the outward facing area of ratcheting assembly portion 122.

Figure 2C:
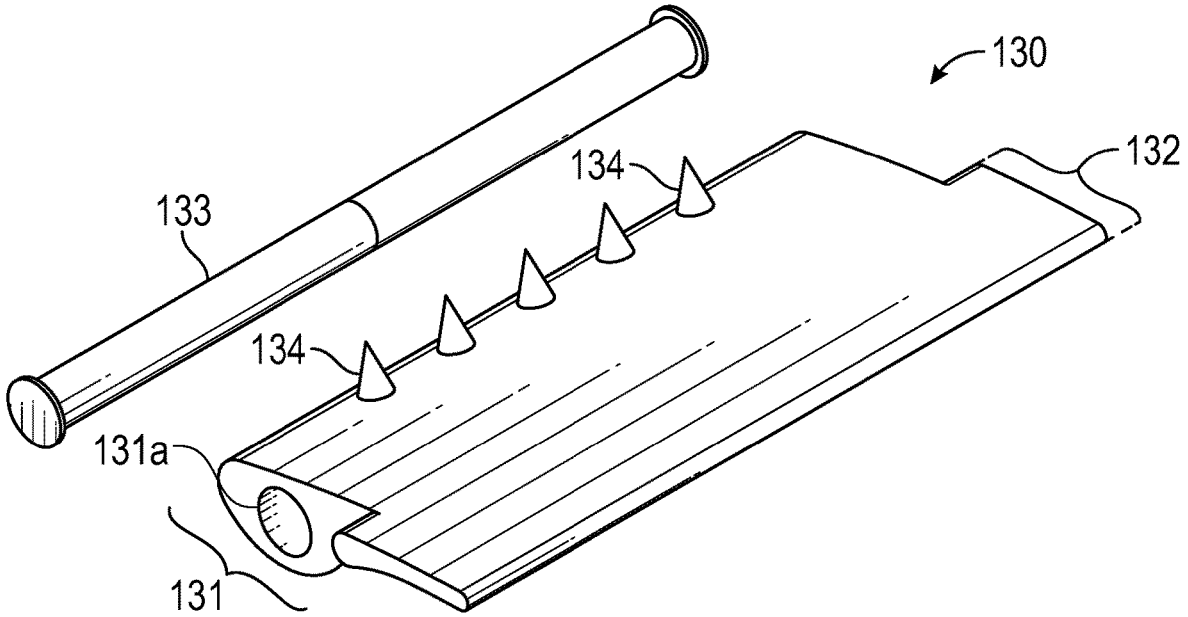
FIG. 2C illustrates a band grip of the ratcheting buckle in isolation.

FIG. 2C illustrates band grip 130 in isolation. Band grip 130 includes a pin channel portion 131 having a pin channel 131*a* extending therethrough and a band grip tab 132. Pin channel portion 131 defines the axis of rotation of band grip 130. One or more pins 133 insert through pin channel 131*a* and through/into pin openings 114 and 121*c* to secure band grip 130 to outer housing 110 and inner housing 120. The combination of band receiving portion 121 and band grip 130 define slot 100*d*. When band grip 130 is in the closed position, band grip tab 132 is positioned within band grip tab receiving slots 115 which causes spikes 134 to protrude into slot 100*d*. In contrast, when band grip 130 is in the open position, band grip tab 132 is pivoted out from band grip tab receiving slots 115 which at least partially withdraws spikes 134 from slot 100*d*. A band can be inserted into and withdrawn from slot 100*d* when band grip 130 is in the open position, whereas, when band grip 130 is pivoted into the closed position while a band is contained within slot 100*d*, spikes 134 will be forced into the band thereby preventing the band from being withdrawn from slot 100*d*.

Figure 2D:
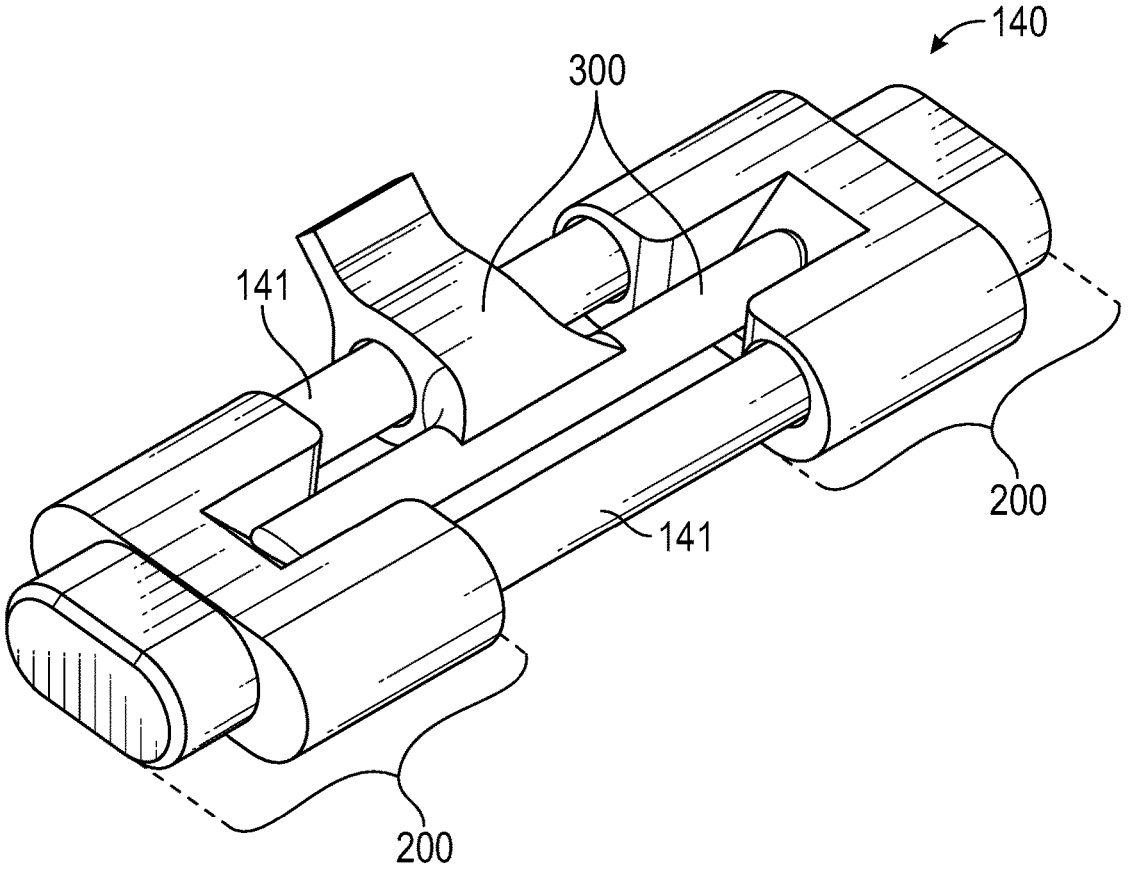
FIG. 2D illustrates a ratcheting assembly of the ratcheting buckle in isolation.

FIG. 2D illustrates ratcheting assembly 140 in isolation. Ratcheting assembly 140 is configured to be contained within ratcheting assembly portion 122 of inner housing 120 and spaced from outer surface 111 of outer housing 110. Ratcheting assembly 140 includes opposing actuating members 200, a ratchet lock 300 and one or more rails 141 which interconnect actuating members 200 and ratchet lock 300. Additional details of ratcheting assembly 140 are described below with reference to FIGS. 3-7.

Figure 2E:
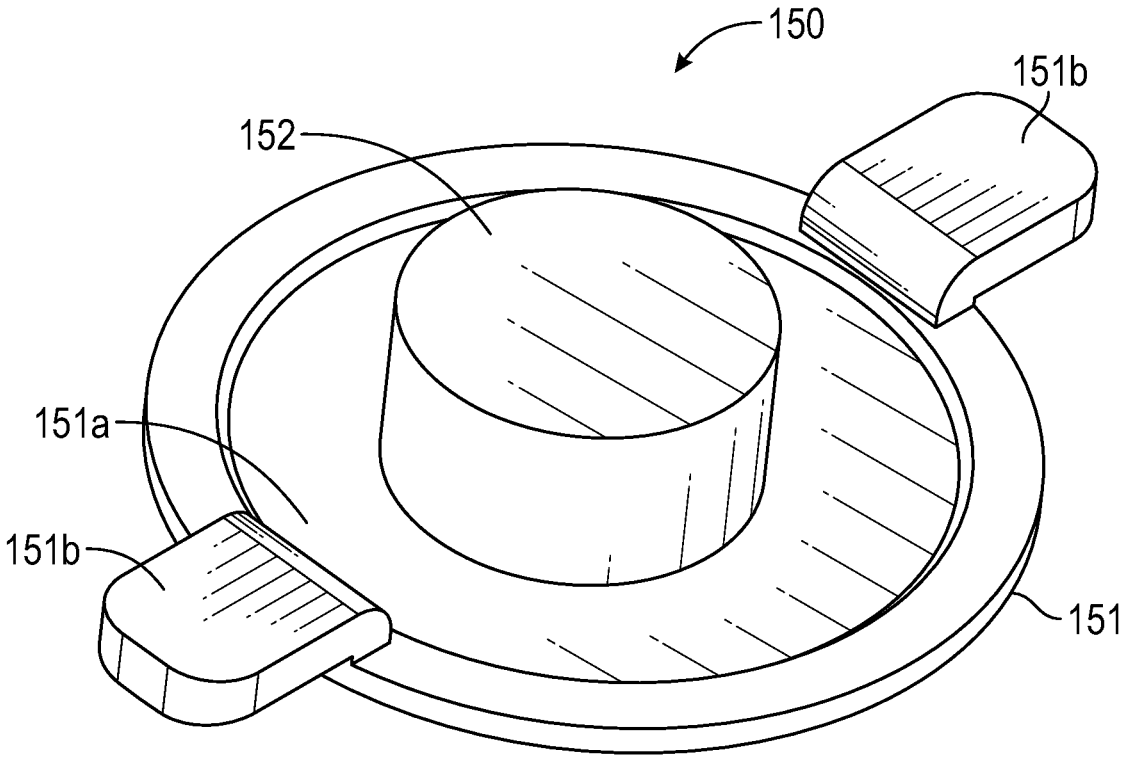
FIG. 2E illustrates a magnet assembly of the ratcheting buckle in isolation.

FIG. 2E illustrates magnet assembly 150 in isolation. Magnet assembly 150 includes a magnet holder 151 and a magnet 152. Magnet holder 151 may be in the form of a plate or cover that includes an inner surface 151 to which magnet 152 is secured and opposing coupling tabs 151*b* that extend outwardly from inner surface 151*a*. With reference again to FIG. 2B, coupling tabs 151*b*, which may initially be oriented directly outward, can be inserted into magnet holder openings 122*f* and then bent inwardly to thereby secure magnet holder 151 to inner surface 122*a* of ratcheting assembly portion 122. This will cause inner surface 151*a* to be positioned overtop magnet opening 122*e* so that magnet 152 will be secured to magnet holder 151 while also being positioned within ratcheting assembly portion 122. Magnet holder 151, or at least inner surface 151*a*, can be formed of a magnetic material to which magnet 152 will be attracted. Alternatively, magnet 152 could be secured to magnet holder 151 via an adhesive, welding or any other suitable technique.

Figure 3:
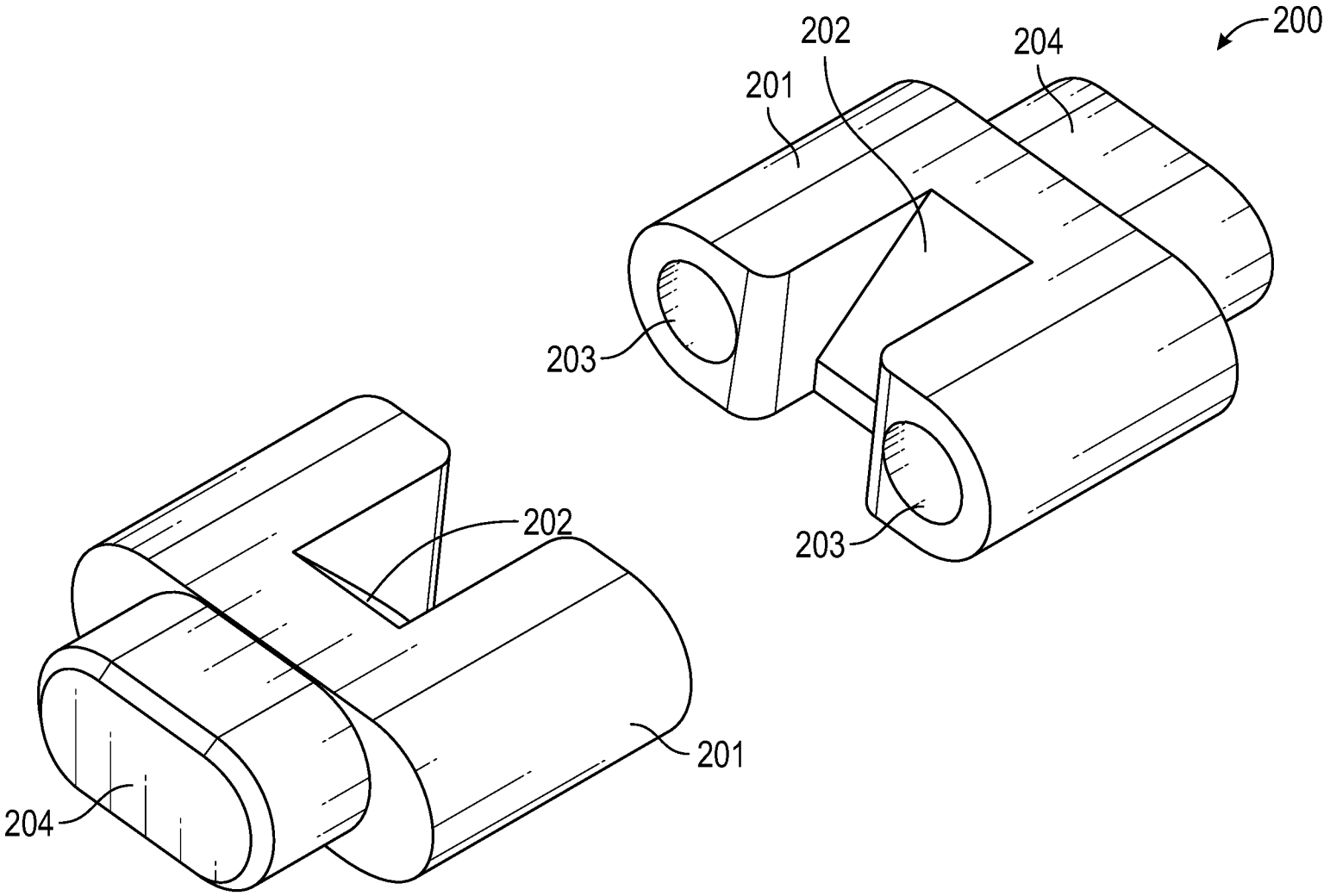
FIG. 3 illustrates actuating members of the ratcheting assembly in isolation.

FIG. 3 illustrates actuating members 200 of ratcheting assembly 140 in isolation. Each actuating member 200 includes a main body 201 which forms an actuating surface 202 between opposing rail openings 203. In some embodiments, springs (not shown) can be positioned inside rail openings 203. Each actuating member 200 also includes a button 204 that extends from main body 201 opposite actuating surface 202. As shown in FIGS. 1A-1G, buttons 204 can extend through button openings 122*c* and 114 so that they are accessible to an individual. Actuating members 200 can be arranged so that actuating surfaces 202 oppose one another and are outwardly oriented. This arrangement will also cause rail openings 203 to be in alignment such that rails 141 can extend between both actuating members 200 to interconnect them.

Figure 4A:
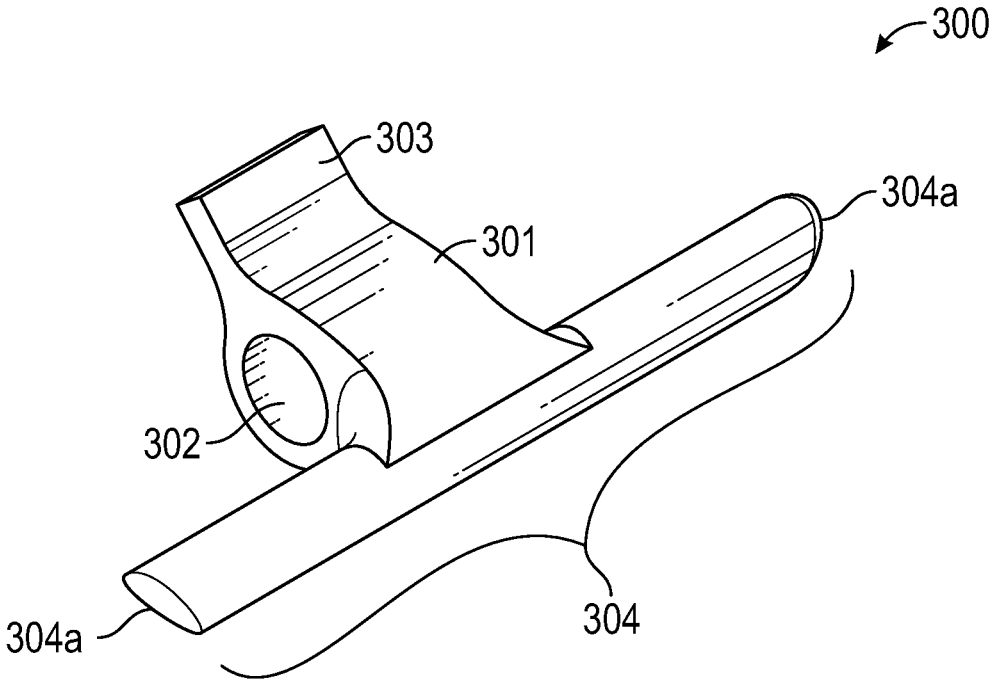
FIGS. 4A and 4B illustrate views of a ratchet lock of the ratcheting assembly in isolation.
Figure 4B:
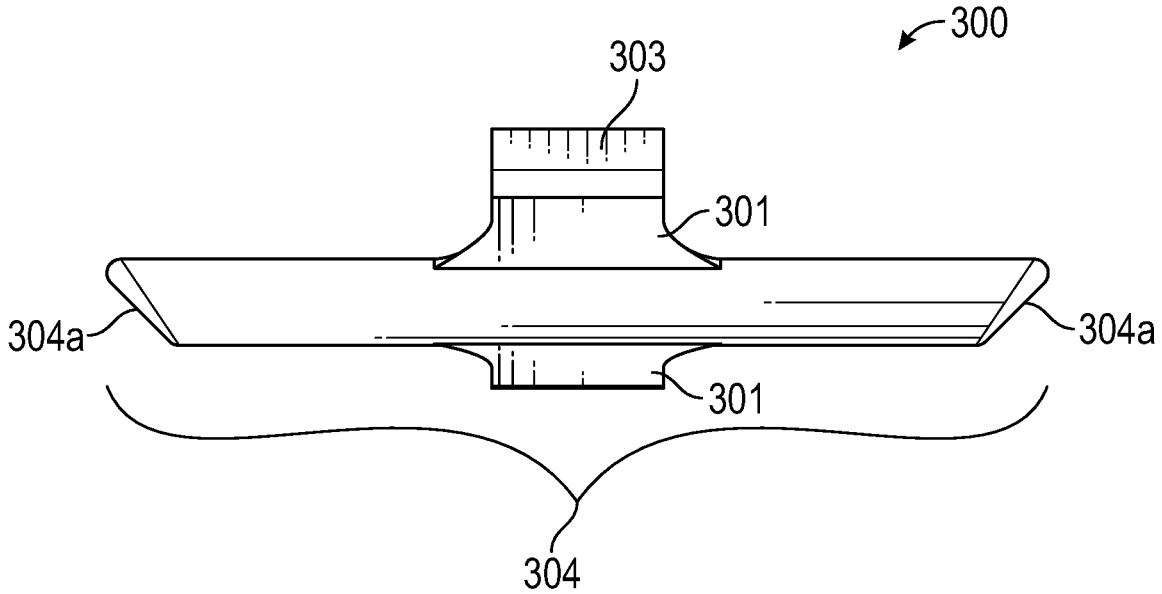

FIGS. 4A and 4B illustrate ratchet lock 300 in isolation. Ratchet lock 300 includes a main body 301 forming a rail channel 302 that defines the axis of rotation of ratchet lock 300 and by which ratchet lock 300 is coupled to rail 141. A locking tab 303 extends outwardly from main body 301 (i.e., towards outer surface 111 of outer housing 110). An actuating member 304 is coupled to main body 301 and extends parallel to the axis of rotation of ratchet lock 300 so that actuating surfaces 304*a* formed at the side ends of actuating member 304 are positioned adjacent to or against actuating surfaces 202 of actuating member 200. Actuating surfaces 304*a* may be inwardly oriented to thereby align with the outwardly oriented actuating surfaces 202.

Figure 5A:
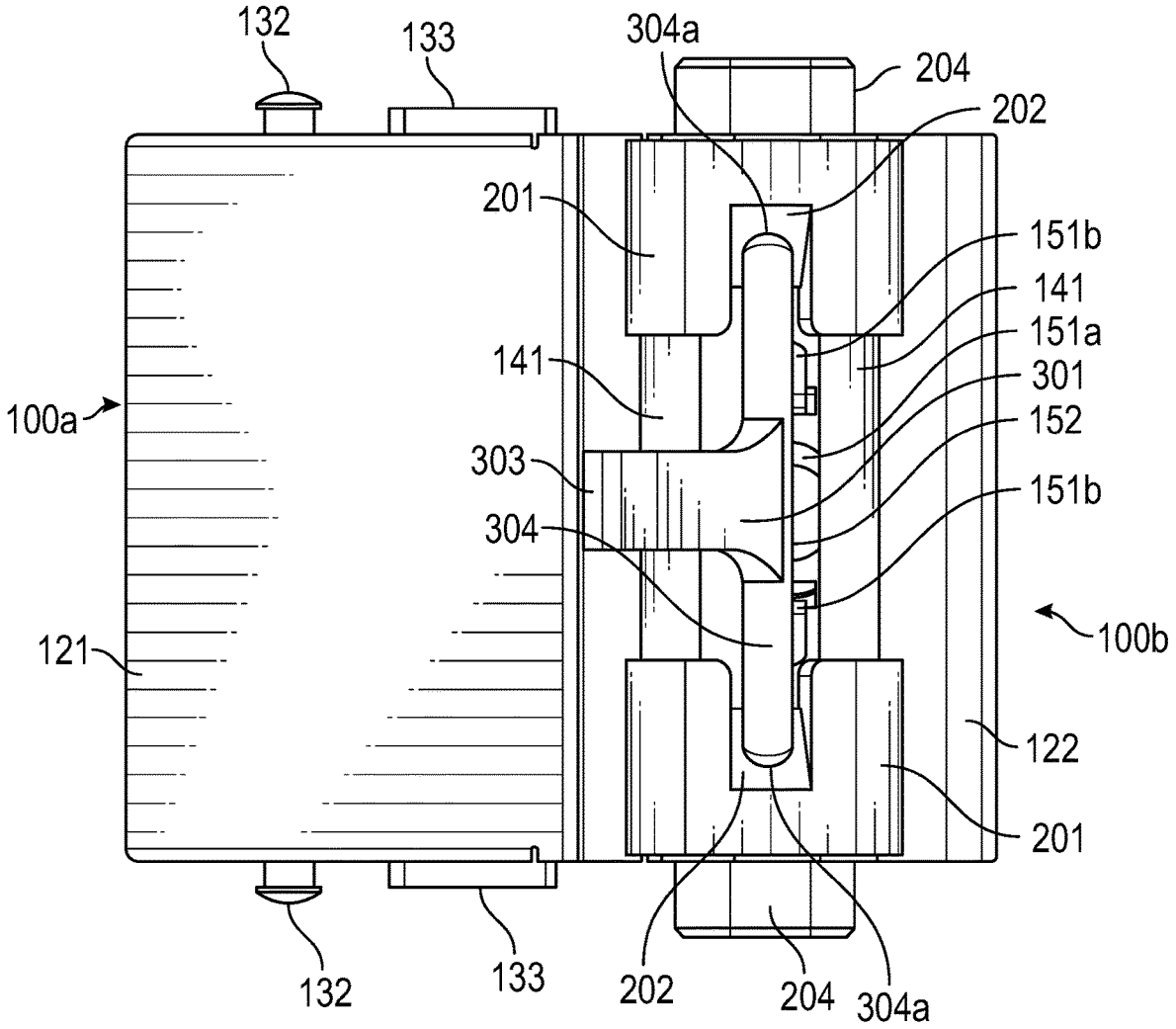
FIGS. 5A and 5B illustrate top and top perspective views respectively of the ratcheting buckle with the outer housing removed.
Figure 5B:
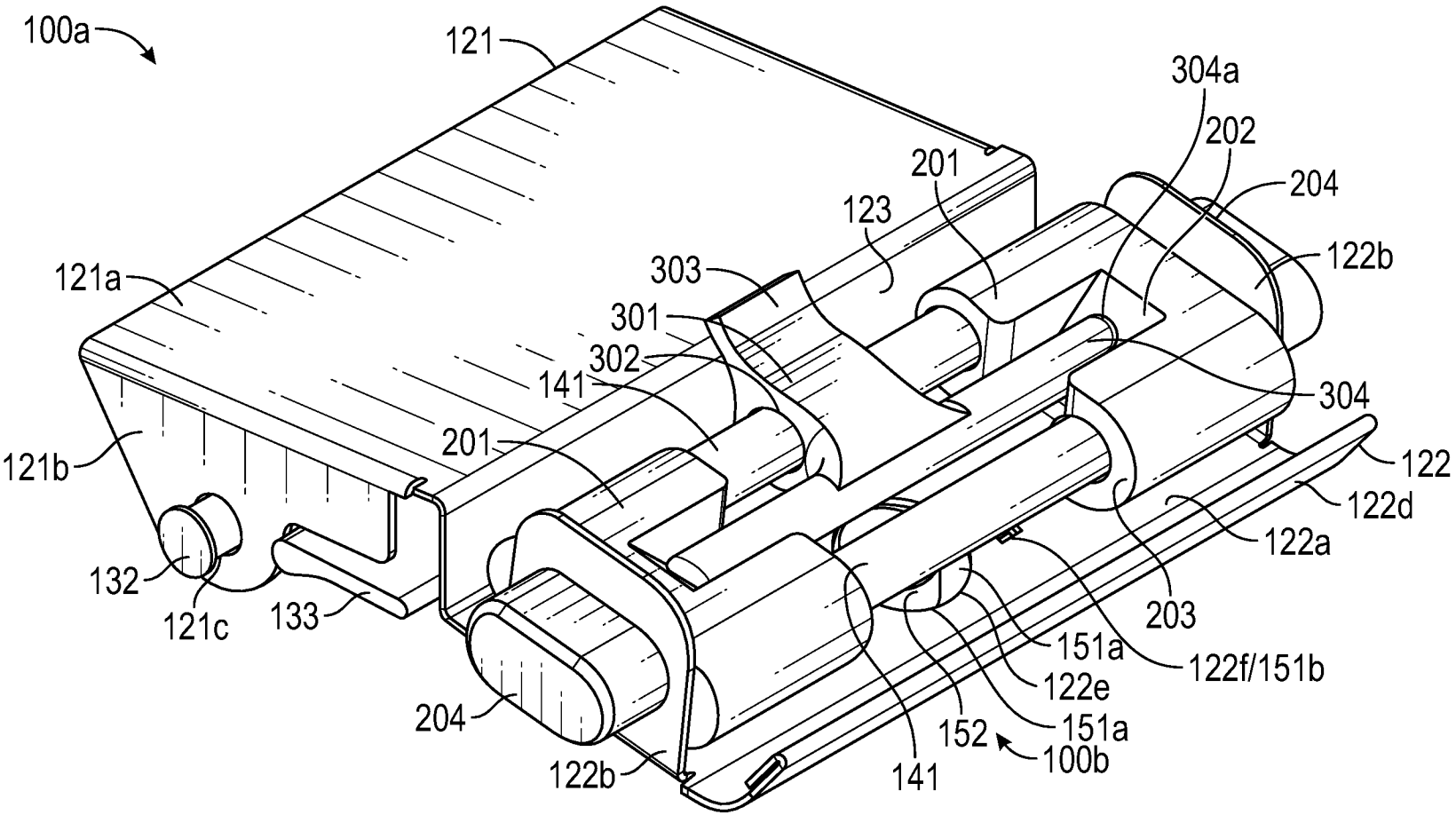

FIGS. 5A and 5B illustrate ratcheting buckle 100 with outer housing 110 removed thereby exposing ratcheting assembly 140. As shown, actuating members 200 are positioned on opposite sides of ratcheting assembly portion 122 with buttons 204 extending through button openings 122*c*. Rails 141 extend between corresponding rail openings 203 on opposing sides of actuating surfaces 202 (i.e., actuating surfaces 202 can be positioned between rails 141). In embodiments that include springs, rails 141 will contact the springs contained in rail openings 203 which biases actuating members 200 apart into the position shown in FIG. 5A (i.e., to cause buttons 204 to extend through button openings 122*c*). Ratchet lock 300 is coupled to the rail 141 that is positioned towards fixed end 100*a* and oriented so that locking tab 303 is positioned towards fixed end 100*a* while actuating member 303 is positioned towards adjustable end 100*b* and within actuating members 200 adjacent to actuating surfaces 202. Magnet assembly 150 can be positioned inwardly from ratchet lock 300 adjacent to actuating member 304.

In FIGS. 5A and 5B, ratcheting assembly 140 is in an unactuated position in which buttons 204 are positioned in the sidewardmost extent of their movement and actuating member 304 is positioned in the inwardmost extent of its rotation. Absent an external (e.g., a squeezing) force on buttons 204, the interaction between magnet assembly 150 and ratchet lock 300 (and the biasing force of the springs when springs are used) will cause actuating members 200 and 304 to be in these positions. In particular, actuating member 304 can be formed of a magnetic material so that magnet 152 will apply an inward biasing force on actuating member 304. Due to this inward biasing force and the arrangement of actuating surfaces 202 and 304*a*, actuating member 304 will apply a sideward force on actuating members 200 as actuating member 304 is moved/attracted inwardly. More particularly, as inwardly oriented actuating surfaces 304*a* slide inwardly along outwardly oriented actuating surfaces 202, actuating members 200, which do not move in an inward or outward direction, will slide sidewardly along rails 141 to accommodate the inward movement of actuating member 304. Since locking tab 303 is positioned on the opposite side of the axis of rotation from actuating member 304, locking tab 303 will move outwardly as actuating member 304 moves inwardly. As a result, locking tab 303 will be in the outwardmost extent of its rotation, which is into channel 100*c*, when ratcheting assembly 140 is in the unactuated position. The use of springs can ensure that actuating members 200 will remain in this unactuated position absent an external force thereby ensuring that magnet 152 can pull actuating member 304 inwardly.

Figure 6A:
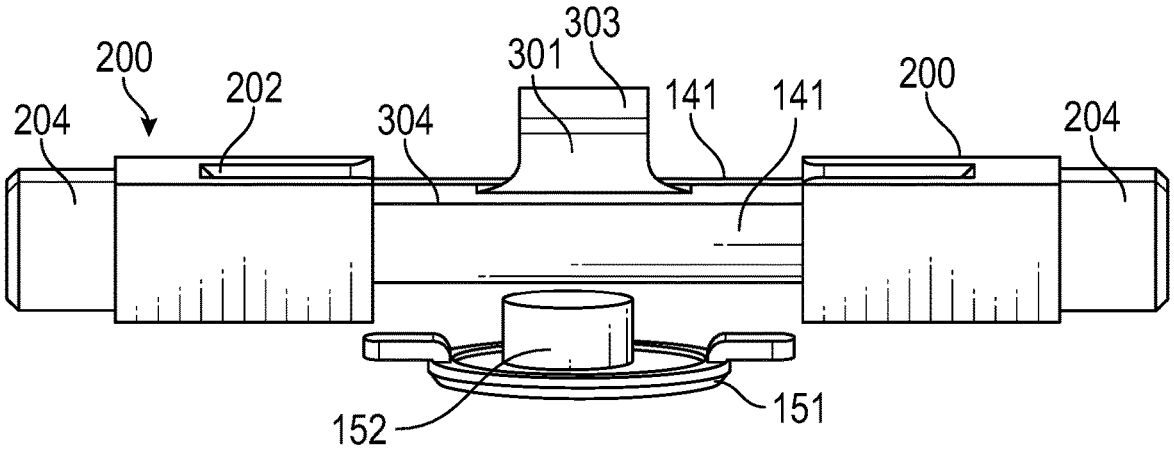
FIGS. 6A and 6B illustrate end views of the ratcheting and magnet assemblies when unactuated and when actuated respectively.
Figure 6B:
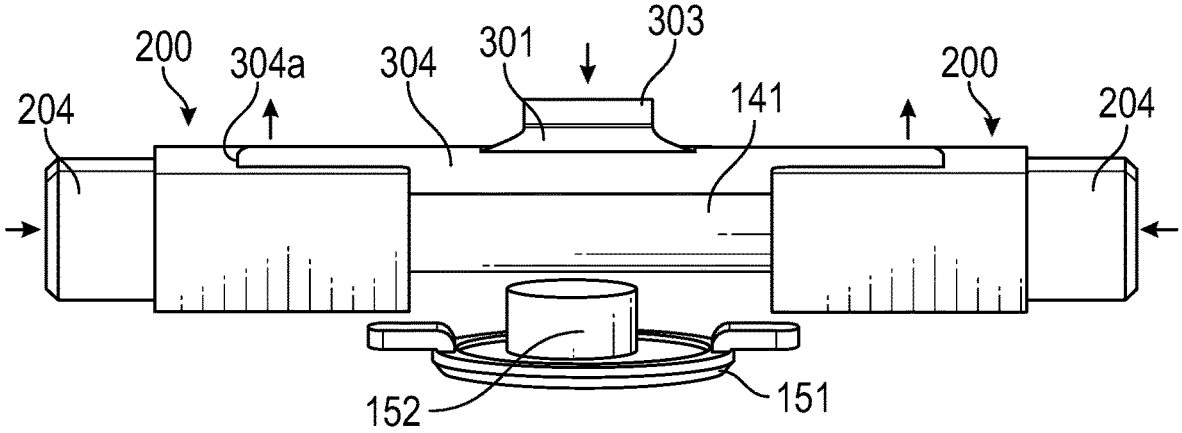

In contrast, when an external force is applied on buttons 204 to slide them sidewardly, the sideward movement of actuating surfaces 202 against actuating surfaces 304*a* will cause actuating member 304 to rotate outwardly thereby causing locking tab 303 to rotate inwardly and withdraw from channel 100*c*. FIGS. 6A and 6B illustrate ratcheting assembly 140 and magnet assembly 150 in isolation in the unactuated and actuated positions. As represented by the arrows in FIG. 6B, a squeezing force on buttons 204 will cause actuating member 304 to move outwardly and locking tab 303 to move inwardly. Once this squeezing force is ceased, magnet 152 will pull actuating member 304 inwardly causing locking tab 303 to return outwardly into channel 100*c*.

Figure 7:
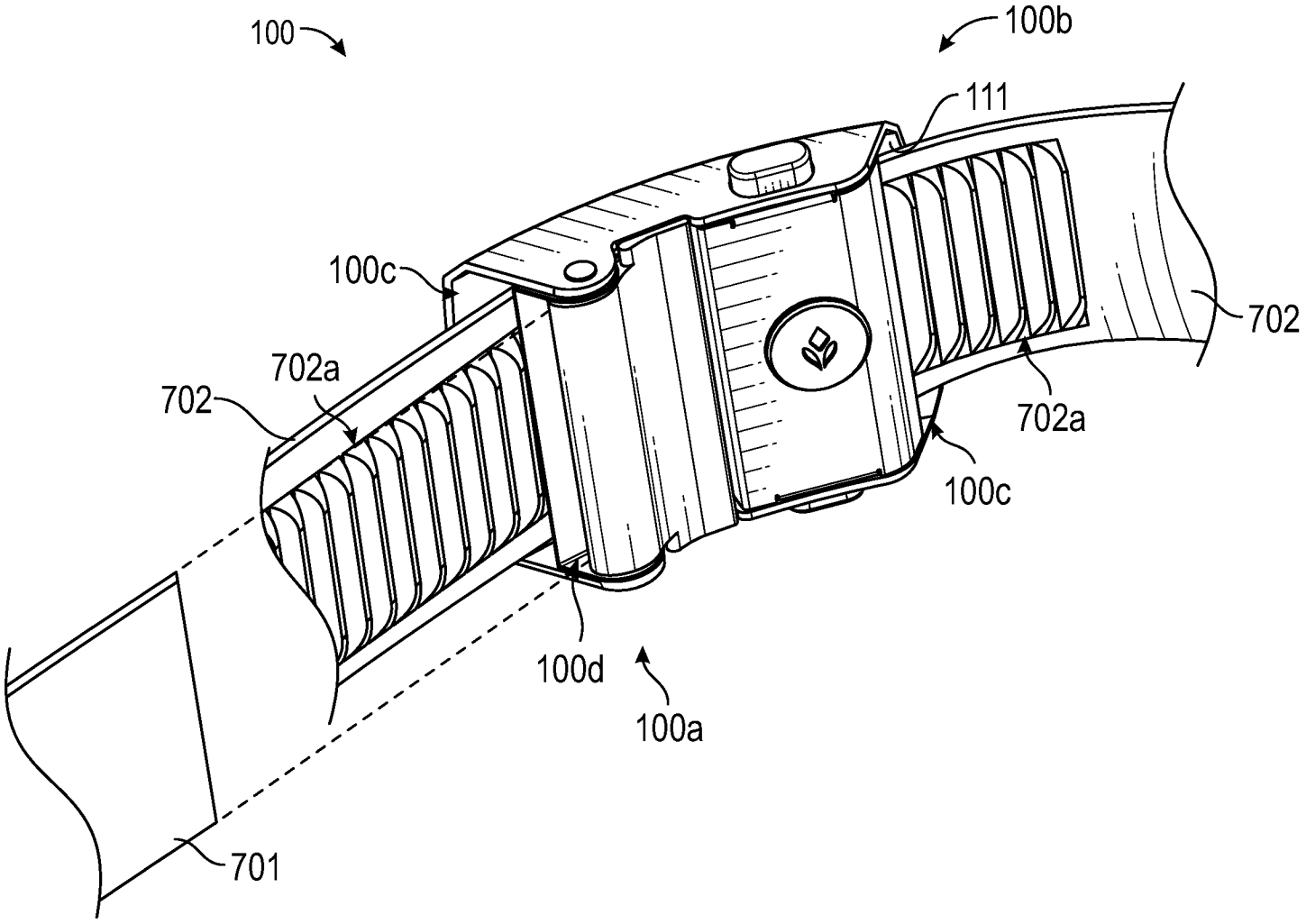
FIG. 7 illustrates how the ratcheting buckle can secure one or more bands.

FIG. 7 illustrates ratcheting buckle 100 in use with two bands 701 and 702. An end of band 701 can be inserted into slot 100*d* via fixed end 100*a* and secured therein with band grip 130. Band 702, which includes ratcheting tabs 702*a* that extend along an inward side of the band, can be inserted into channel 100*c* via adjustable end 100*b*. As band 702 is inserted, ratcheting tabs 702*a* will contact locking tab 303 and cause it to pivot inwardly so as to not block the insertion. Then, once band 702 has been inserted the desired distance, the biasing force of magnet 152 will cause locking tab 303 to be pivoted outwardly to position it between ratcheting tabs 702*a*. The orientation of locking tab 303 towards fixed end 100*a* will cause the end of the locking tab 303 to contact the adjacent ratcheting tab 702*a*. If a force is applied to band 702 in the direction of adjustable end 100*b*, the adjacent ratcheting tab 702*a* will apply a force to locking tab 303 in a generally outward direction. However, locking tab 303 will be unable to rotate further outward due to the interaction between actuating surfaces 202 and actuating surfaces 304*a* (i.e., actuating members 200 will not slide further sideways to accommodate further rotation of ratchet lock 300). In contrast, if a squeezing force is applied to buttons 204, locking tab 303 will be rotated inwardly thereby freeing it from ratcheting tabs 702*a* thus allowing band 702 to be withdrawn. In this way, ratcheting assembly 140 prevents band 702 from being withdrawn unintentionally.

Although bands 701 and 702 are assumed to be two different bands, they could equally represent opposing ends of a single band. Ratcheting buckle 100 can therefore be used on a wide range of apparel items and may also be used with or on other types of items that may employ a band or bands. With regards to apparel, ratcheting buckle 100 can form an interchangeable component of the apparel. For example, a watch may be provided with multiple sets of bands where each set can be used with ratcheting buckle 100. Similarly, ratcheting buckle 100 may be provided with multiple belts (or bands) of different colors.

Although the depicted embodiment of ratcheting buckle 100 includes opposing actuating members 200, some embodiments of the present invention could employ a single actuating member 200 to perform substantially the same function as described above. For example, one end of actuating member 304 could be configured in the manner described above while the other end could be fixed to inner housing 120, coupled to another structure or simply removed. In such cases, the inward movement of the single actuating member 200 would still cause actuating member 304 to be moved outwardly as described above. Accordingly, even though the use of opposing actuating members 200 provides symmetry in appearance and function, the present invention should not be limited to such embodiments.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed:

1. A ratcheting buckle comprising:

an outer housing;

an inner housing that couples to the outer housing to form a channel;

a ratcheting assembly that is positioned within the outer housing adjacent to the channel, the ratcheting assembly comprising opposing actuating members that are configured to move along an axis and a ratchet lock that is configured to rotate about the axis and that includes a locking tab; and a magnet assembly that applies a biasing force to the ratchet lock to thereby cause the locking tab to be inserted into the channel absent an external force on the opposing actuating members;

wherein the opposing actuating members are interfaced with the ratchet lock such that, as the opposing actuating members are moved along the axis, the ratchet lock rotates about the axis to cause the locking tab to be selectively positioned within the channel.

2. The ratcheting buckle of claim 1, wherein the opposing actuating members are interfaced with the ratchet lock such that, as the opposing actuating members are moved closer together along the axis, the ratchet lock rotates about the axis to withdraw the locking tab from the channel, whereas, as the opposing actuating members are moved farther apart along the axis, the ratchet lock rotates about the axis to insert the locking tab into the channel.

3. The ratcheting buckle of claim 1, wherein the magnet assembly is positioned inwardly from the ratchet lock.

4. The ratcheting buckle of claim 1, wherein the opposing actuating members each form an actuating surface, and wherein the ratchet lock includes a ratchet lock actuating member that extends parallel to the axis and that includes actuating surfaces that interface with the actuating surfaces of the opposing actuating members.

5. The ratcheting buckle of claim 4, wherein the actuating surfaces of the opposing actuating members are outwardly oriented, and the actuating surfaces of the ratchet lock actuating member are inwardly oriented.

6. The ratcheting buckle of claim 4, wherein the ratchet lock actuating member is positioned on a first end of the ratchet lock, the locking tab is positioned on a second end of the ratchet lock and the axis is positioned between the first and second ends of the ratchet lock.

7. The ratcheting buckle of claim 4, wherein the magnet assembly is positioned inwardly from the ratchet lock actuating member, the magnet assembly applying a biasing force to pull the ratchet lock actuating member towards the magnet assembly.

8. The ratcheting buckle of claim 1, wherein the opposing actuating members include buttons that extend through the outer housing to thereby enable an individual to apply an external force on the buttons to cause the opposing actuating members to move along the axis.

9. The ratcheting buckle of claim 1, further comprising:

a band grip that is positioned within the outer housing.

10. The ratcheting buckle of claim 1, further comprising:

a band having ratcheting tabs that is configured to insert into the channel.

11. A ratcheting buckle comprising:

an outer housing forming an outer surface;

an inner housing that couples to the outer housing to form a channel between the outer surface and the inner housing; and a ratcheting assembly comprising opposing actuating members, a ratchet lock and a first rail that interconnects the opposing actuating members and the ratchet lock, the first rail defining an axis along which the opposing actuating members move and about which the ratchet lock rotates, the ratchet lock including a locking tab that rotates into and out from the channel as the ratchet lock rotates about the axis.

12. The ratcheting buckle of claim 11, wherein the opposing actuating members interface with the ratchet lock to cause the ratchet lock to rotate about the axis as the opposing actuating members move along the axis.

13. The ratcheting buckle of claim 11, wherein the opposing actuating members form outwardly oriented actuating surfaces and the ratchet lock includes a ratchet lock actuating member that forms inwardly oriented actuating surfaces that interface with the outwardly oriented actuating surfaces.

14. The ratcheting buckle of claim 13, wherein the locking tab and the ratchet lock actuating member are positioned on opposite sides of the axis, and wherein, when the opposing actuating members are moved closer together along the axis, the outwardly oriented actuating surfaces apply an outward force on the inwardly oriented actuating surfaces to thereby cause the ratchet lock actuating member to move outwardly and the locking tab to move inwardly.

15. The ratcheting buckle of claim 14, further comprising:

a magnet assembly that applies an inward biasing force on the ratchet lock actuating member to thereby cause the locking tab to be inserted into the channel absent an external force on the opposing actuating members.

16. A ratcheting buckle comprising:

an outer housing forming an outer surface;

an inner housing that couples to the outer housing to form a channel between the outer surface and the inner housing;

a ratcheting assembly comprising opposing actuating members and a ratchet lock that is interconnected with the opposing actuating members, the opposing actuating members being configured to move along an axis, the ratchet lock being configured to rotate around the axis, the ratchet lock including a locking tab and a ratchet lock actuating member, wherein the opposing actuating members include outwardly oriented actuating surfaces and the ratchet lock actuating member includes inwardly oriented actuating surfaces that are positioned against the outwardly oriented actuating surfaces; and a magnet assembly that is positioned adjacent the ratchet lock actuating member.

17. The ratcheting buckle of claim 16, wherein the locking tab and the ratchet lock actuating member are positioned on opposite sides of the axis, and wherein, when the opposing actuating members are moved closer together along the axis, the outwardly oriented actuating surfaces apply an outward force on the inwardly oriented actuating surfaces to thereby cause the ratchet lock actuating member to move outwardly and the locking tab to move inwardly.

18. The ratcheting buckle of claim 16, wherein the magnet assembly applies an inward biasing force against the ratchet lock actuating member.

19. The ratcheting buckle of claim 16, wherein each of the opposing actuating members includes a button that extends beyond the outer housing to thereby enable an individual to apply an external force to cause the opposing actuating members to move along the axis.

20. The ratcheting buckle of claim 16, wherein the locking tab and the ratchet lock actuating member are positioned on opposing sides of the axis such that outward movement of the ratchet lock actuating member causes inward movement of the locking tab.

* * * * *